US009334594B2

(12) United States Patent
Torigoe

(10) Patent No.: US 9,334,594 B2
(45) Date of Patent: May 10, 2016

(54) SEWN PRODUCT AND SEWING METHOD OF MATERIAL

(75) Inventor: Noriko Torigoe, Kanagawa (JP)

(73) Assignees: Gotalio Co., Ltd. (JP); YKK Corporation (JP)

( * ) Notice: Subject to any disclaimer, the term of this patent is extended or adjusted under 35 U.S.C. 154(b) by 159 days.

(21) Appl. No.: 14/237,652

(22) PCT Filed: Jun. 27, 2012

(86) PCT No.: PCT/JP2012/066400

§ 371 (c)(1),
(2), (4) Date: Feb. 20, 2014

(87) PCT Pub. No.: WO2013/021746

PCT Pub. Date: Feb. 14, 2013

(65) Prior Publication Data

US 2014/0182498 A1 Jul. 3, 2014

(30) Foreign Application Priority Data

Aug. 8, 2011 (JP) ..... 2011-173200

(51) Int. Cl.

| | |
|---|---|
| ***D05B 1/12*** | (2006.01) |
| ***D05B 23/00*** | (2006.01) |
| ***D05B 3/02*** | (2006.01) |
| ***D05B 93/00*** | (2006.01) |

(52) U.S. Cl.

CPC *D05B 23/00* (2013.01); *D05B 1/12* (2013.01); *D05B 3/025* (2013.01); *D05B 93/00* (2013.01)

(58) Field of Classification Search

CPC ..... D05B 1/18; D05B 1/20; D05B 1/22

USPC ..... 112/440, 441, 443, 450, 452

See application file for complete search history.

(56) References Cited

U.S. PATENT DOCUMENTS

| | | | | | |
|---|---|---|---|---|---|
| 1,119,865 | A | * | 12/1914 | Parkes | D05B 19/00 112/452 |
| 1,383,604 | A | * | 7/1921 | Crozet | D05B 3/02 112/452 |
| 1,848,029 | A | * | 3/1932 | Schindelheim | D05B 3/02 112/81 |
| 2,029,942 | A | * | 2/1936 | Armstrong | D05B 3/02 112/232 |
| 2,074,849 | A | * | 3/1937 | Macbride | D05B 35/06 112/227 |

(Continued)

FOREIGN PATENT DOCUMENTS

| | | |
|---|---|---|
| JP | 46-19610 Y1 | 7/1971 |
| JP | 50-22145 Y1 | 7/1975 |

(Continued)

OTHER PUBLICATIONS

Office Action, Chinese Patent Application No. 2012800384439, mailed Apr. 8, 2015.

(Continued)

*Primary Examiner* — Danny Worrell

(74) *Attorney, Agent, or Firm* — Kilpatrick Townsend & Stockton LLP

(57) ABSTRACT

There is provided a sewn product in which one material edge and the other material edge are stitched together in an abutted state. The one material edge and the other material edge are stitched together with one bobbin thread and a plurality of needle threads, the plurality of needle threads being interlocked with the one bobbin thread to form a plurality of rows of zigzag stitched seams.

6 Claims, 10 Drawing Sheets

(56) References Cited

U.S. PATENT DOCUMENTS

| | | | | | |
|---|---|---|---|---|---|
| 2,169,590 | A | * | 8/1939 | Myers | D05B 35/02 112/425 |
| 2,354,783 | A | * | 8/1944 | Sturzlinger | D05B 19/00 112/452 |
| 2,635,568 | A | * | 4/1953 | Gellman | D05B 19/00 112/452 |
| 3,296,987 | A | * | 1/1967 | Kawaguchi | D05B 19/00 112/464 |
| 3,318,272 | A | * | 5/1967 | Taketomi | D05B 19/00 112/221 |
| 3,438,347 | A | * | 4/1969 | Taketomi | D05B 55/16 112/221 |
| 4,573,420 | A | * | 3/1986 | Carson | D05B 35/02 112/142 |
| 2010/0224111 | A1 | * | 9/2010 | Ihira | D05B 3/14 112/445 |

FOREIGN PATENT DOCUMENTS

| | | | |
|---|---|---|---|
| JP | 15080/1990 | | 1/1990 |
| JP | H10-295967 | A | 11/1998 |
| JP | 2000-197783 | A | 7/2000 |

OTHER PUBLICATIONS

Written Opinion, PCT Application No. PCT/JP2012/066400, mailed Oct. 2, 2012.

International Search Report, PCT Application No. PCT/JP2012/066400 mailed Oct. 2, 2012.

* cited by examiner

| SAMPLE | TEST METHOD | |
|---|---|---|
| | GRAB METHOD PURSUANT TO JISL-1093 | JISL-1098 TEARING METHOD |
| A: 80/A COMPACT SMOOTH | 156 N (CUT OF MATERIAL THREAD) | 899 kN/m$^2$ (CUT OF MATERIAL THREAD) |
| B:10500F FLY SPEECH SKIN | 203 N (CUT OF MATERIAL THREAD) | 1050 kN/m$^2$ (CUT OF STITCHING THREAD AND MATERIAL THREAD) |

SEWN PRODUCT AND SEWING METHOD OF MATERIAL

This application is a national stage application of PCT/JP2012/066400, which claims priority to Japanese Patent Application No. 2011-173200, both of which are incorporated herein by reference.

TECHNICAL FIELD

The present invention relates to a sewn product in which material edges are stitched together and a sewing method of the same.

BACKGROUND ART

There is known a sewing method of material in which material edges are stitched together with using a flat seamer sewing machine having four or five needles and with six threads (e.g. refer to Patent Document 1). According to the sewing method using the flat seamer sewing machine, since the material edges are stitched together in the abutted state, the unevenness in a stitched portion can be reduced. In addition, since the material edges are stitched together with six threads, the strength of the stitched portion can be ensured.

PRIOR ART DOCUMENT

Patent Document

Patent Document 1: Japanese Patent Application Publication No. 2000-197783A

SUMMARY OF INVENTION

Problems to Be Solved by Invention

However, in the sewing method of material using the flat seamer sewing machine, since the material edges are stitched together with six threads, the thickness of the stitched portion is increased due to the thickness of the threads. In addition, since the stitched portion has a large width, the stitched portion is noticeable.

Accordingly, the present invention has been made keeping in mind the above problems, and an object of the present invention is to provide a sewn product in which material edges are stitched together and a sewing method of the same, in which the unevenness of a stitched portion is reduced, the stitched portion is less noticeable, and the strength of the stitched portion can be ensured.

Means for Solving Problems

In order to accomplish the above-described object, according to the present invention, there is provided a sewn product in which one material edge and the other material edge are stitched together in an abutted state. The one material edge and the other material edge are stitched together with one bobbin thread and a plurality of needle threads, the plurality of needle threads being interlocked with the one bobbin thread to form a plurality of rows of zigzag stitched seams.

In the sewn product, two rows of the plurality of rows of zigzag stitched seams may be formed by two needle threads of the plurality of needle threads, and wherein the one material edge may be overedge-stitched by one of the two needle threads and the bobbin thread, and the other material edge may be overedge-stitched by the other of the two needle threads and the bobbin thread.

In the sewn product, three rows of the plurality of rows of zigzag stitched seams may be formed by three needle threads of the plurality of needle threads. One of the three needle threads may be stitched alternately to the one material edge and the other material edge. The other two of the three needle threads may be stitched to the one material edge or the other material edge at both sides of the one needle thread.

According to the present invention, there is provided a sewing method of material in which one material edge and the other material edge are stitched together in an abutted state. The sewing method comprises interlocking a plurality of needle threads with one bobbin thread such that the plurality of needle threads form a plurality of rows of zigzag stitched seams to stitch the one material edge and the other material edge together.

In the sewing method of material, the one material edge and the other material edge may be stitched together with using a sewing machine which comprises a vertical full rotation shuttle and a plurality of sewing needles, the plurality of sewing needles being arranged in a direction perpendicular to a feed direction of the material and being swayable in the direction perpendicular to the feed direction of the material.

Advantageous Effects of Invention

According to the present invention, it is possible to provide a sewn product in which material edges are stitched together and a sewing method of the same, in which the unevenness of a stitched portion is reduced, the stitched portion is less noticeable, and the strength of the stitched portion can be ensured.

EMBODIMENTS OF INVENTION

Figure 1:
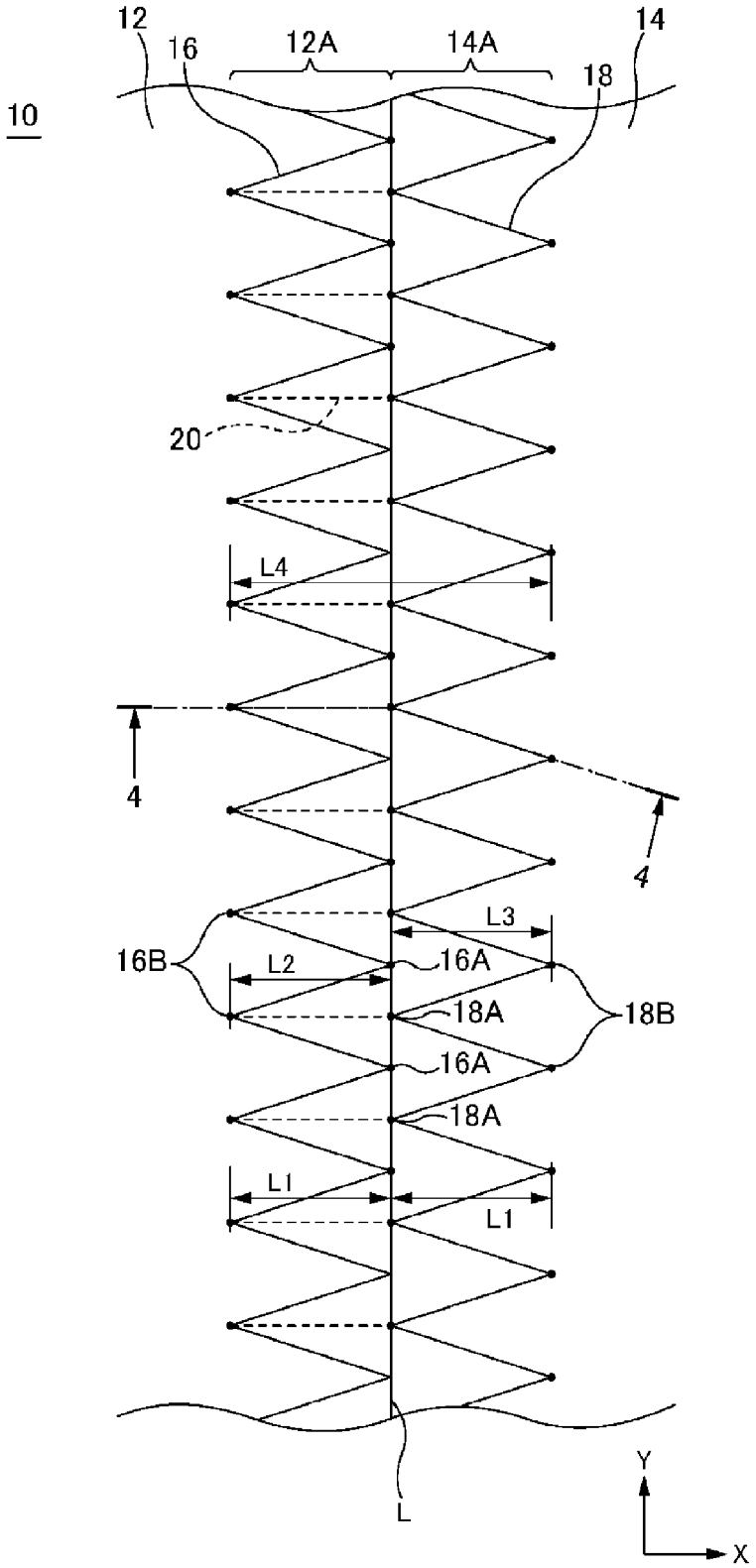
FIG. 1 is a top plan view showing one surface of a sewn product according to one embodiment.
Figure 2:
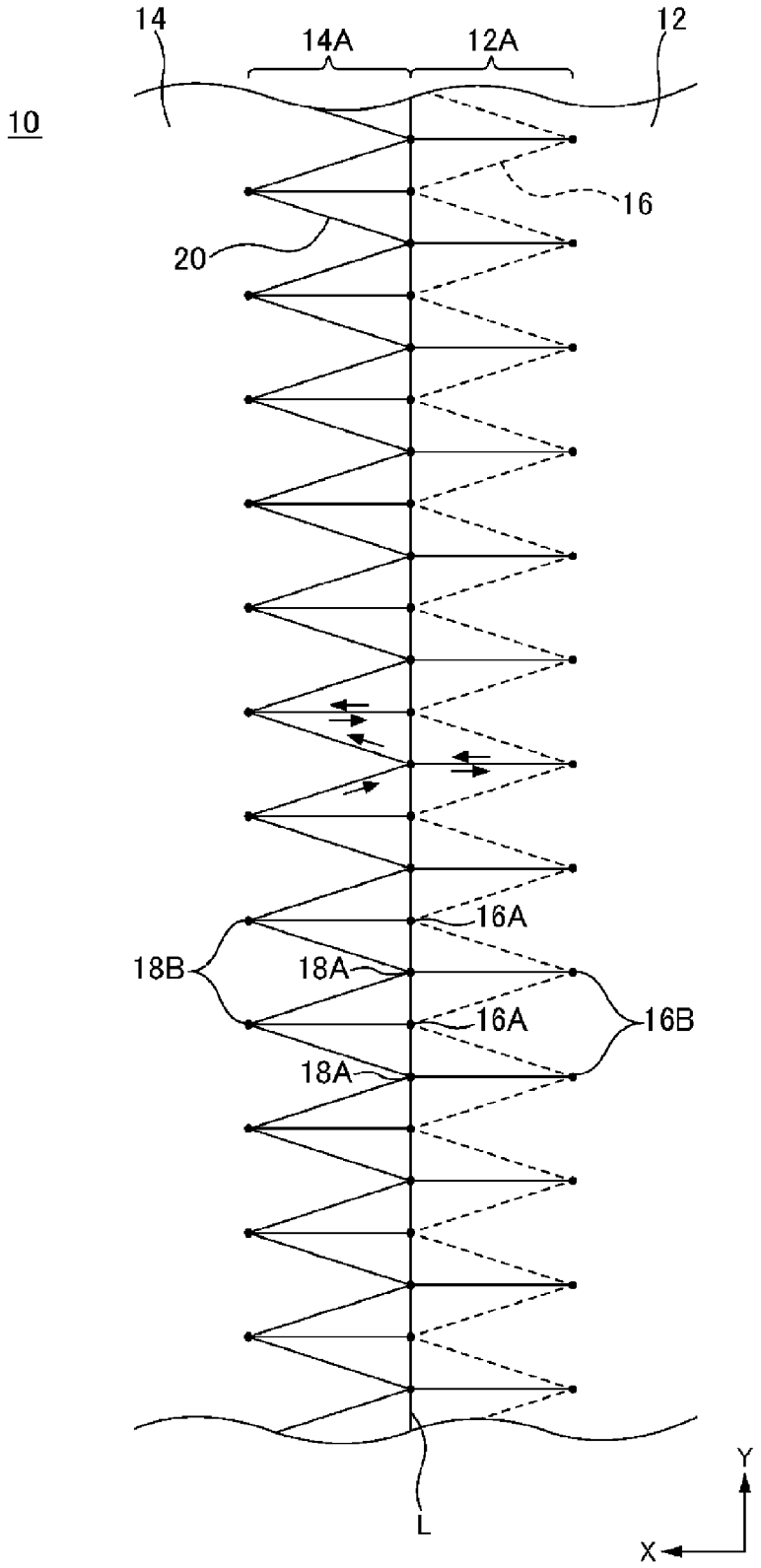
FIG. 2 is a top plan view showing the other surface of the sewn product.

Hereinafter, one embodiment of the present invention will be described with reference to the accompanying drawings. FIG. 1 is a top plan view showing one surface of a sewn product 10 according to one embodiment, and FIG. 2 is a top plan view showing the other surface of the sewn product 10. As shown in these figures, the sewn product 10 is made by abutting an edge portion 12A of a piece of material 12 (hereinafter referred to as the material edge 12A) and an edge portion 14A of a piece of material 14 (hereinafter referred to as the material edge 14A) to each other and stitching the material edge 12A and the material edge 14A in a flat state. The pieces of material 12 and 14 are felt cloth, knit, compressed wool knit, jersey, or the like, and the sewn product 10 is a garment such as underwear or an outerwear.

Two needle threads 16 and 18 and one bobbin thread 20 are used for stitching the material edges 12A and 14A. In the following description, a surface of the sewn product 10, on which the needle threads 16 and 18 are exposed as stitched seams is referred to as a front, and a surface of the sewn product 10, on which the bobbin thread 20 is exposed as stitched seams is referred to as a rear.

The two needle threads 16 and 18 are arranged in parallel while sandwiching a boundary line L where the material edges 12A and 14A are abutted to each other. The needle thread 16 forms the zigzag stitched seams at a front side of the material edge 12A, and the needle thread 18 forms the zigzag stitched seams at a front side of the material edge 14A. The needle threads 16 and 18 are interlocked with the bobbin thread 20 at turning points 16A, 16B, 18A and 18B, thereby forming knots.

All of the turning points 16A of the needle threads 16 at a side of the boundary line L and the turning points 18A of the bobbin thread 18 at a side of the boundary line L are positioned on the boundary line L. The turning points 16A and 18B are arranged in a direction perpendicular to the boundary line L (in X direction in the figures), the turning points 16B and 18A are also arranged in the X direction, and intervals L1 thereof are set to a preset value (e.g. 2.00 mm). An interval L2 between the turning points 16A and the turning points 16B in the X direction and an interval L3 between the turning points 18A and the turning points 18B in the X direction are set to a preset value (e.g. 2.00 mm). Accordingly, a width L4 of the stitched seams formed by the needle threads 16 and 18 becomes a preset value (e.g. 4.00 mm).

As shown in FIG. 2, the bobbin thread 20 extends in the direction of the boundary line L (Y direction in the figures) while passing through the turning points 16A, 16B, 18A and 18B at a rear side of the material edges 12A and 14A. Here, following the bobbing thread 20 in the Y direction, the bobbin thread 20 passes through the individual turning points in the sequence of 18B→18A→16B→18A→18B→16A→18B (hereinafter repeated).

Figure 3:
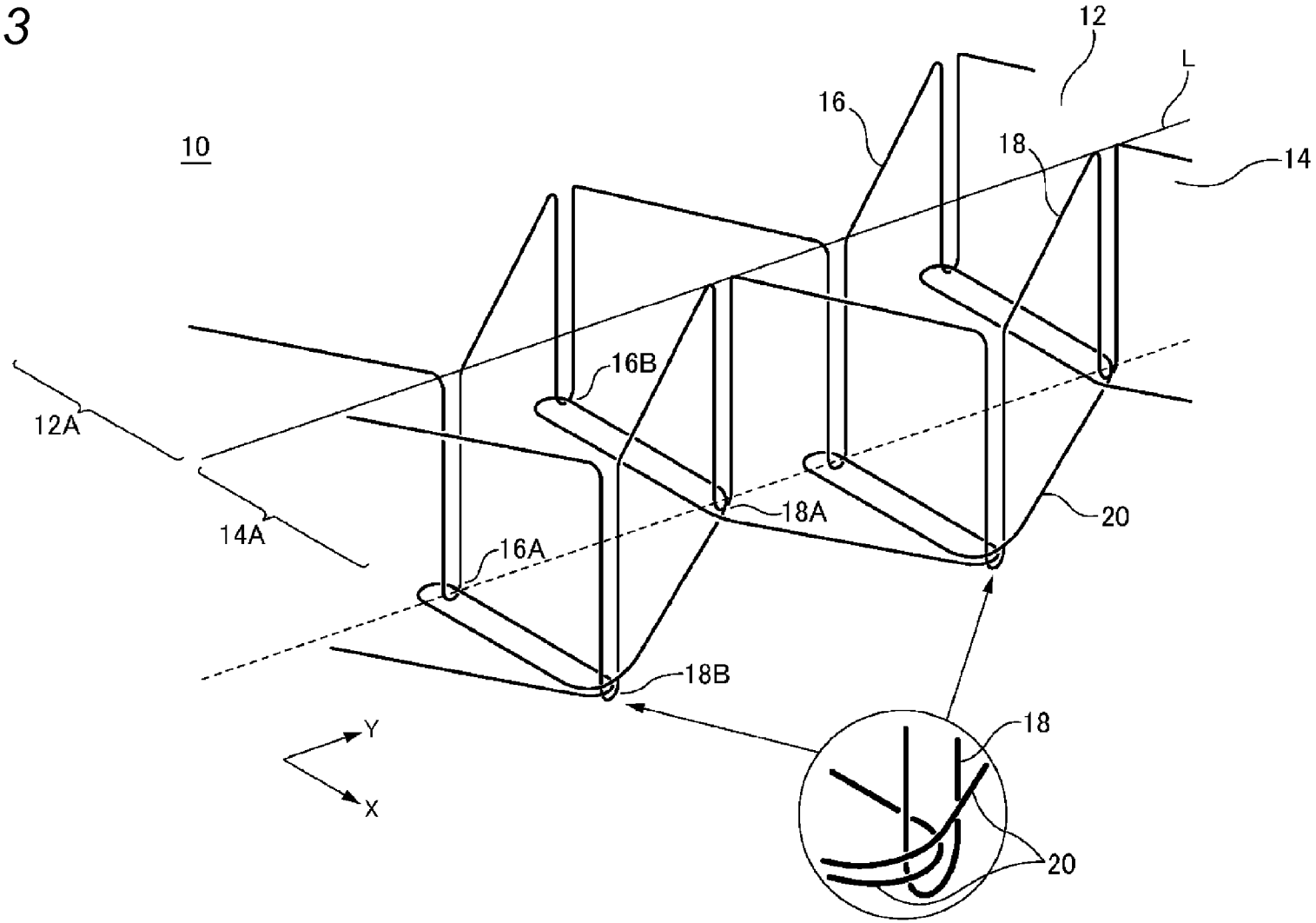
FIG. 3 is a three-dimensional view showing a sewing configuration at a stitched portion.

FIG. 3 is a three-dimensional view showing a sewing configuration of the stitched portion of the material edges 12A and 14A. As shown in this figure, following the configuration of the bobbin thread 20 in the Y direction, the bobbin thread 20 forms a knot together with the needle thread 18 at the turning point 18B and then forms a knot together with the needle thread 16 at the next turning point 16A. Then, the bobbin thread 20 passes through the turning point 18B, forms a knot together with the needle thread 18 at the turning point 18A and then forms a knot at the next turning point 16B. Afterwards, the bobbin thread 20 passes through the turning point 18A, forms a knot together with the needle thread 18 at the turning point 18B and then forms a knot at the next turning point 16A. These configurations are repeated.

Figure 4:
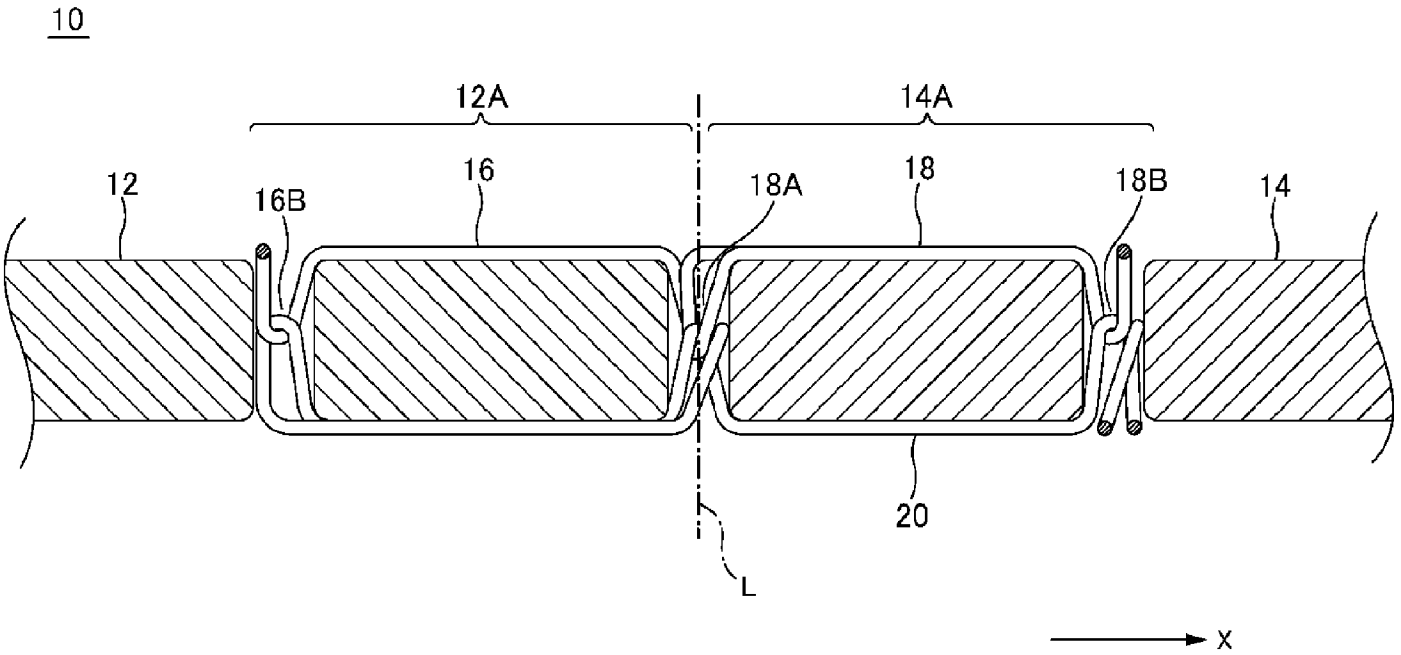
FIG. 4 is a cross-sectional view taken along line 4-4 in FIG. 1.

FIG. 4 is a cross-sectional view taken along line 4-4 in FIG. 1. As shown in this figure, the material edge 12A is overedge-stitched by the needle thread 16 and the bobbin thread 20 between the turning points 16B-16A and the material edge 14A is overedge-stitched by the needle thread 18 and the bobbin thread 20 between the turning points 18B-18A.

Here, since the tension of the needle thread 16 and the bobbin thread 20 that are interlocked together to surround the material edge 12A acts so as to compress the material edge 12A, the density of the material edge 12A is increased. In addition, since the tension of the needle thread 18 and the bobbin thread 20 that are interlocked together to surround the material edge 14A acts so as to compress the material edge 14A, the density of the material edge 14A is increased.

Figure 5:
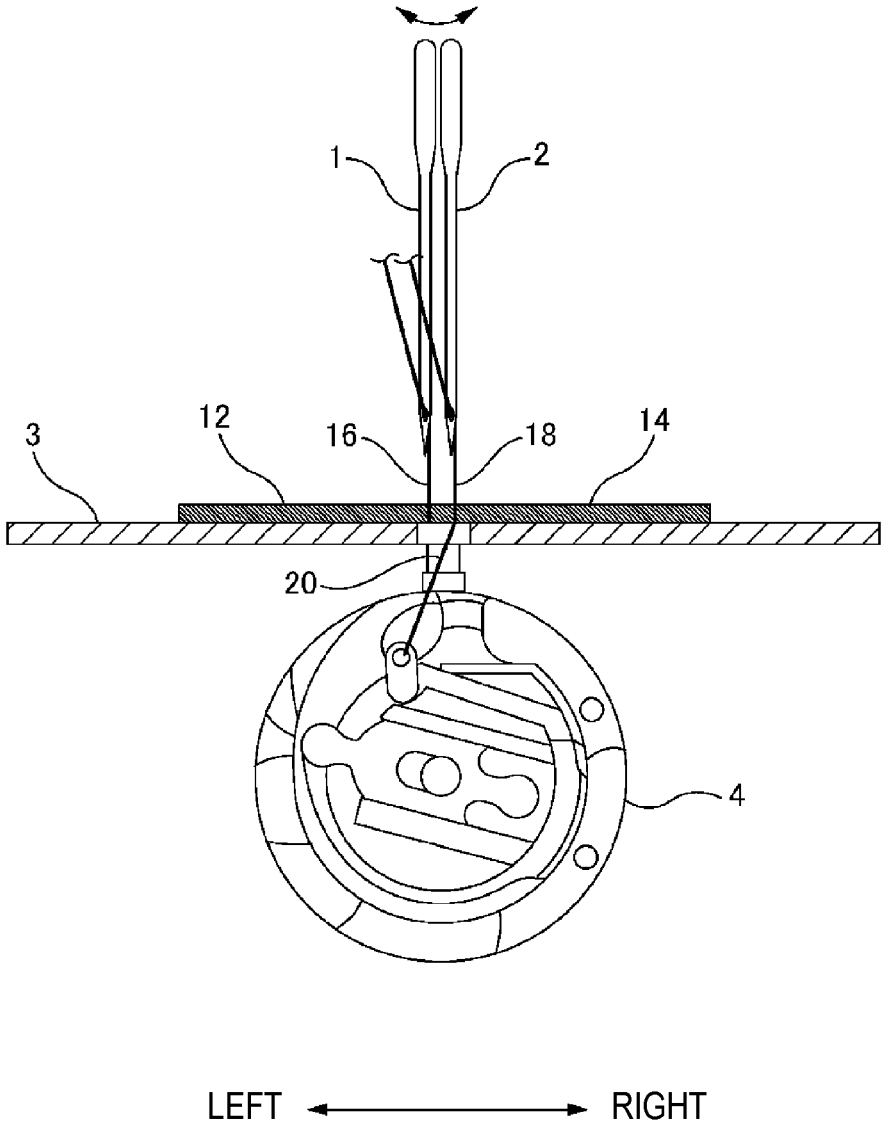
FIG. 5 is an elevation view showing one embodiment of a material sewing method.
Figures 6, 7:
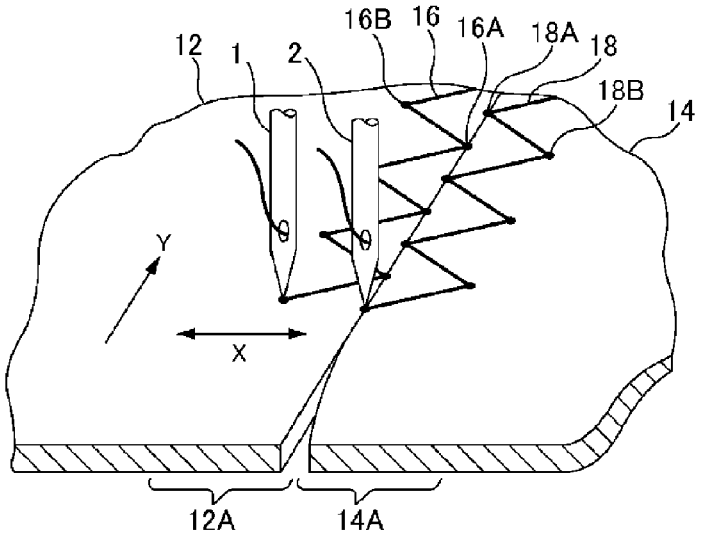
FIG. 6 is a perspective view showing one embodiment of the material sewing method.
FIG. 7 is a table showing a result of a strength test on stitched portions.

FIG. 5 is an elevation view showing one embodiment of a material sewing method, and FIG. 6 is a perspective view showing the material sewing method according to this embodiment. As shown in FIG. 5, a sewing machine to be used in stitching the material edge 12A and the material edge 14A together includes two sewing needles 1 and 2, a vertical full rotation shuttle 4, and a throat plate 3 which is disposed between the sewing needles 1 and 2 and the vertical full rotation shuttle 4. The two sewing needles 1 and 2 are arranged parallel in the direction (the right and left direction in the figure) that is perpendicular to a material feed direction (from a near side to a far side in the figure), and are configured to be moved upward and downward and to be swayed in the right and left direction in the figure by an swaying mechanism which is not shown. The needle thread 16 is passed through a thread hole of the sewing needle 1, and the needle thread 18 is passed through a thread hole of the sewing needle 2.

The vertical full rotation shuttle 4 is a shuttle which rotates counterclockwise in the figure about a rotary shaft that is parallel to the material feed direction, and provided with a bobbin (not shown) around which the bobbin thread 20 is wound, a sword tip (not shown) which widens loops of the needle threads 16 and 18, or the like. The throat plate 3 is formed with holes through which the sewing needles 1 and 2 pass.

A reference will be made to the sequence of stitching the material edge 12A and the material edge 14A together with using the sewing machine configured as above. As shown in FIG. 6, the sewing needles 1 and 2 with the needle threads 16 and 18 having passed through the thread holes thereof are caused to penetrate through the turning points 16B and 18A, and the vertical full rotation shuttle 4 is rotated while the sewing needles 1 and 2 are being pulled upward. Here, the loops of the needle threads 16 and 18 are widened by the sword tip of the vertical full rotation shuttle 4, the bobbin thread 20 is caused to pass through the loops, and in that state, the needle threads 16 and 18 are pulled upward. This causes the needle thread 16 and the bobbin thread 20 to form a knot at the turning point 16B and the needle thread 18 and the bobbin thread 20 to form a knot at the turning point 18A.

Afterwards, the pieces of material 12 and 14 are fed in the Y direction, and the sewing needles 1 and 2 are swayed to the right in the figure so as to respectively penetrate through the turning points 16A and 18B. The vertical full rotation shuttle 4 is rotated while the sewing needles 1 and 2 are being pulled upward. This causes the needle thread 16 and the bobbin thread 20 to form a knot at the turning point 16A and the needle thread 18 and the bobbin thread 20 to form a knot at the turning point 18B.

In subsequence, the pieces of material 12 and 14 are fed in the Y direction, and the sewing needles 1 and 2 are swayed to the left in the figure so as to respectively penetrate through the turning points 16B and 18A. The vertical full rotation shuttle 4 is rotated while the sewing needles 1 and 2 are being pulled upward. This causes the needle thread 16 and the bobbin thread 20 to form a knot at the turning point 16B and the needle thread 18 and the bobbin thread 20 to form a knot at the turning point 18A. The above-described sequences are repeated, and thus the material edge 12A and the material edge 14A are sewn by being zigzag stitched into two rows while being overedge-stitched by the needle threads 16 and 18 and the bobbin thread 20.

FIG. 7 is a table showing the result of a strength test on stitched portions. As shown in this table, in this test, the strengths of stitched portions of two samples A and B were measured using a grab method pursuant to JISL-1093 and a JISL-1098 tearing method as test methods.

In Sample A, edges of pieces of material composed of cotton 100% (product number: 80/Z compact smooth) were stitched with each other with using the above-described sewing method according to the present invention. In Sample B, edges of pieces of material composed of cashmere 5% and cotton 95% (product number: 10500F fly speech skin) were stitched with each other with using the above-described sewing method according to the present invention.

It is typical that the strengths of the stitched portion produced by stitching the edges of the pieces of material, such as material for a skirt or pants, material for a sweater, material for a shirt or a blouse, is tested using the JISL-1098 tearing method and that a reference value for evaluation is set to the range from 350 to 400 $kN/m^2$. In contrast, the results of the test taken on Sample A and Sample B in the JISL-1098 tearing method were respectively 899 $kN/m^2$ and 1050 $kN/m^2$, which are significantly above the reference value for evaluation.

The results of the test taken on Samples A and B in the grab method pursuant to JISL-1093 were respectively 156 N and 203N. When Sample A was cut in the tests according to the two types of test methods as described above, the material threads were cut in both cases. In addition, when Sample B was cut in the tests according to the two types of test methods as described above, the material threads were cut in the grab method, whereas the sewing threads and material threads were cut in the tearing method.

As described above, the stitched portion of the sewn product 10 produced by sewing the material edges 12A and 14A together via two-row zigzag stitching with two needle threads 16 and 18 and one bobbin thread 20 has a sufficient amount of tensile strength since the density of the material edges 12A and 14A is increased by the tension of two needle threads 16 and 18 and one bobbin thread 20.

Since the material edges 12A and 14A are sewn with a small number of threads, i.e. three threads, it is possible to reduce the thickness of the stitched portion compared to that of the stitched portion with six threads using the flat seamer sewing machine. It is possible to reduce the unevenness of the stitched portion or make the stitched portion less noticeable. In addition, since the width of stitching can be reduced compared to that of the stitched portion with six threads using the flat seamer sewing machine, the stitched portion can be made much more less noticeable. Here, when the sewn product 10 is a garment such as an underwear that touches the skin, it is possible to improve wearing sensation (tactility) by reducing the unevenness of the stitched portion. In addition, when the sewn product 10 is a garment such as an outerwear in which the stitched seams are exposed to the outside, it is possible to improve the quality of design by making the stitched portions less noticeable.

In addition, in the sewn product 10 according to this embodiment, since the material edge 12A is overedge-stitched with the needle thread 16 and the bobbin thread 20 and the material edge 14A is overedge-stitched with the needle thread 18 and the bobbin thread 20, the material edges 12A and 14A can be prevented from being untied.

Figure 8:
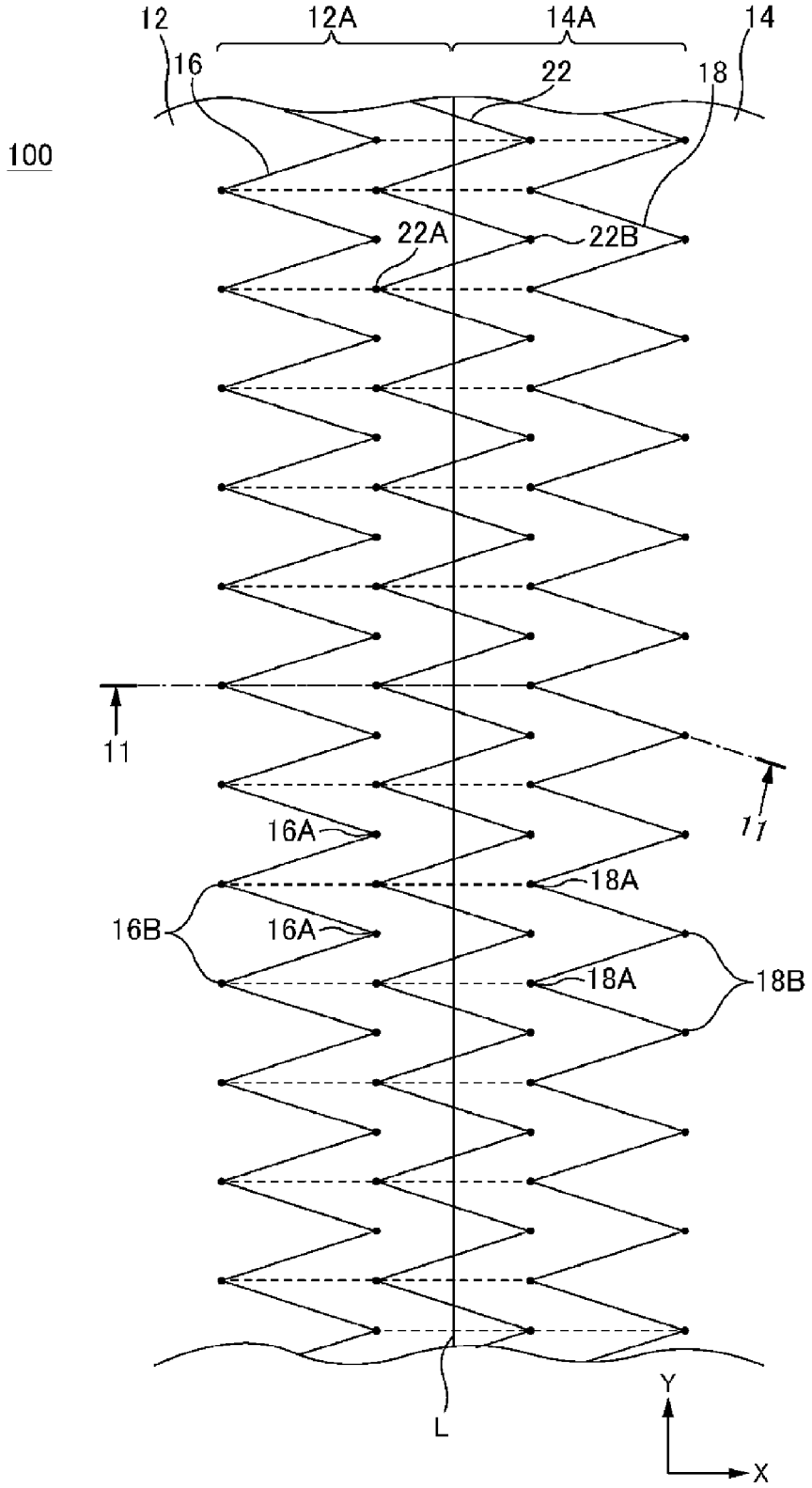
FIG. 8 is a top plan view showing one surface of a sewn product according to another embodiment.
Figure 9:
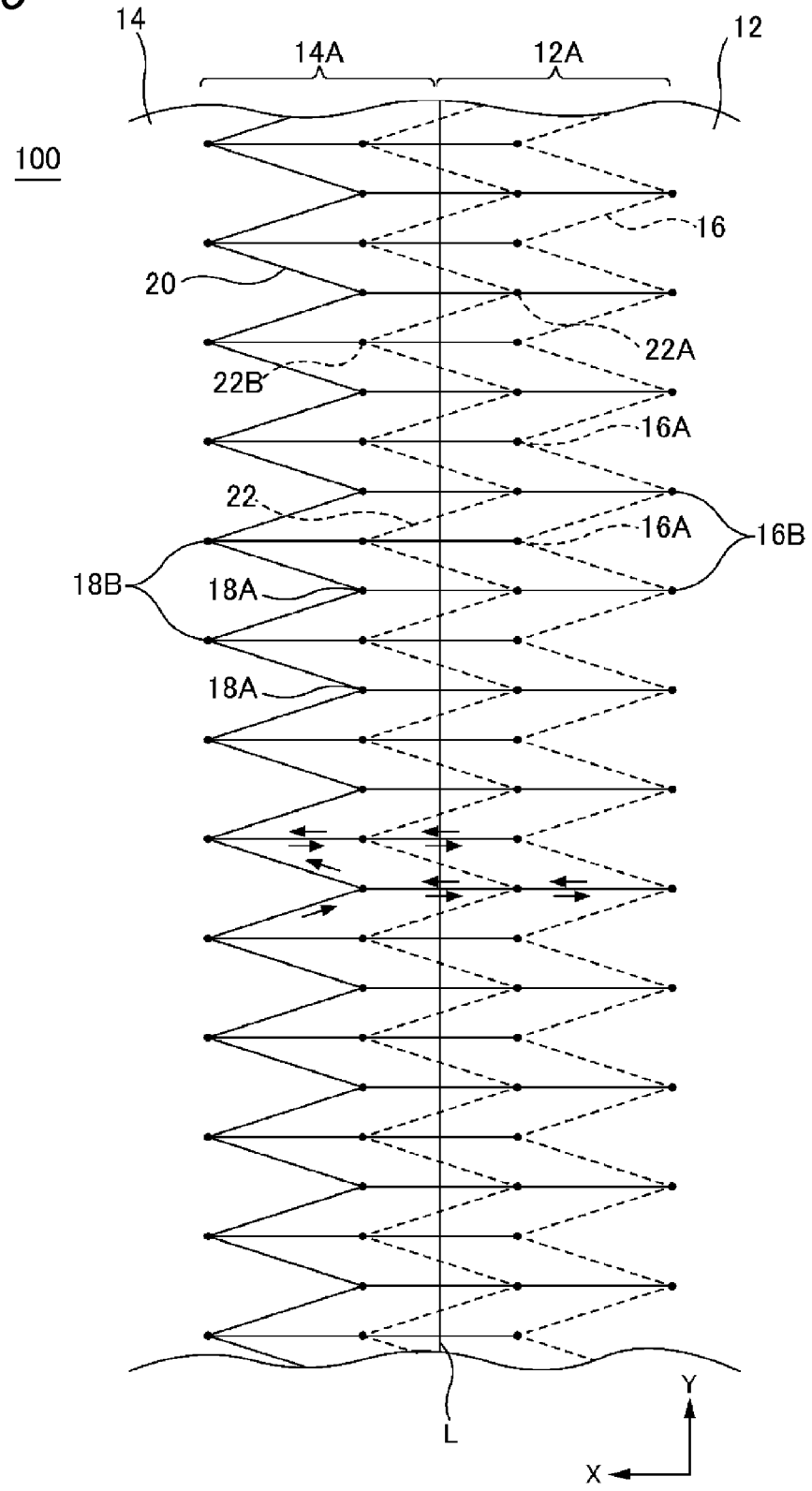
FIG. 9 is a top plan view showing the other surface of the sewn product.

FIG. 8 is a top plan view showing one surface of a sewn product 100 according to another embodiment, and FIG. 9 is a top plan view showing the other surface of the sewn product 100. As shown in these figures, three needle threads 16, 18 and 22 and one bobbin threads 20 are used for stitching the material edges 12A and 14A.

The two needle threads 16 and 18 are arranged in parallel while sandwiching the boundary line L where the material edges 12A and 14A are abutted to each other. The needle thread 16 forms zigzag stitched seams at a front side of the material edge 12A, and the needle thread 18 forms zigzag stitched seams at a front side of the material edge 14A. In addition, the needle thread 22 forms zigzag stitched seams at front sides of the material edge 12A and of the material edge 14A while bridging over the boundary line L. The needle threads 16, 18 and 22 are respectively interlocked with the bobbin thread 20 at the turning points 16A, 16B, 18A, 18B, 22A and 22B, thereby forming knots.

The turning points 22A and 22B of the needle threads 22 are respectively positioned on the material edges 12A and 12B. The turning points 16A, 22B and 18B are arranged in the direction perpendicular to the boundary line (X direction in the figure), and the turning points 16B, 22A and 18A are arrange in the X direction.

As shown in FIG. 9, the bobbin thread 20 extends in the direction of the boundary line L (Y direction in the figure) at rear sides of the material edges 12A and 14A while passing through the turning points 16A, 16B, 18A, 18B, 22A and 22B. Following the bobbin thread 20 in the Y direction, the bobbin thread 20 passes through the individual turning points in the sequence of 18B→18A→22B→16B→22B→18A→18B→22A→16A→22A→18B (hereinafter repeated).

Figure 10:
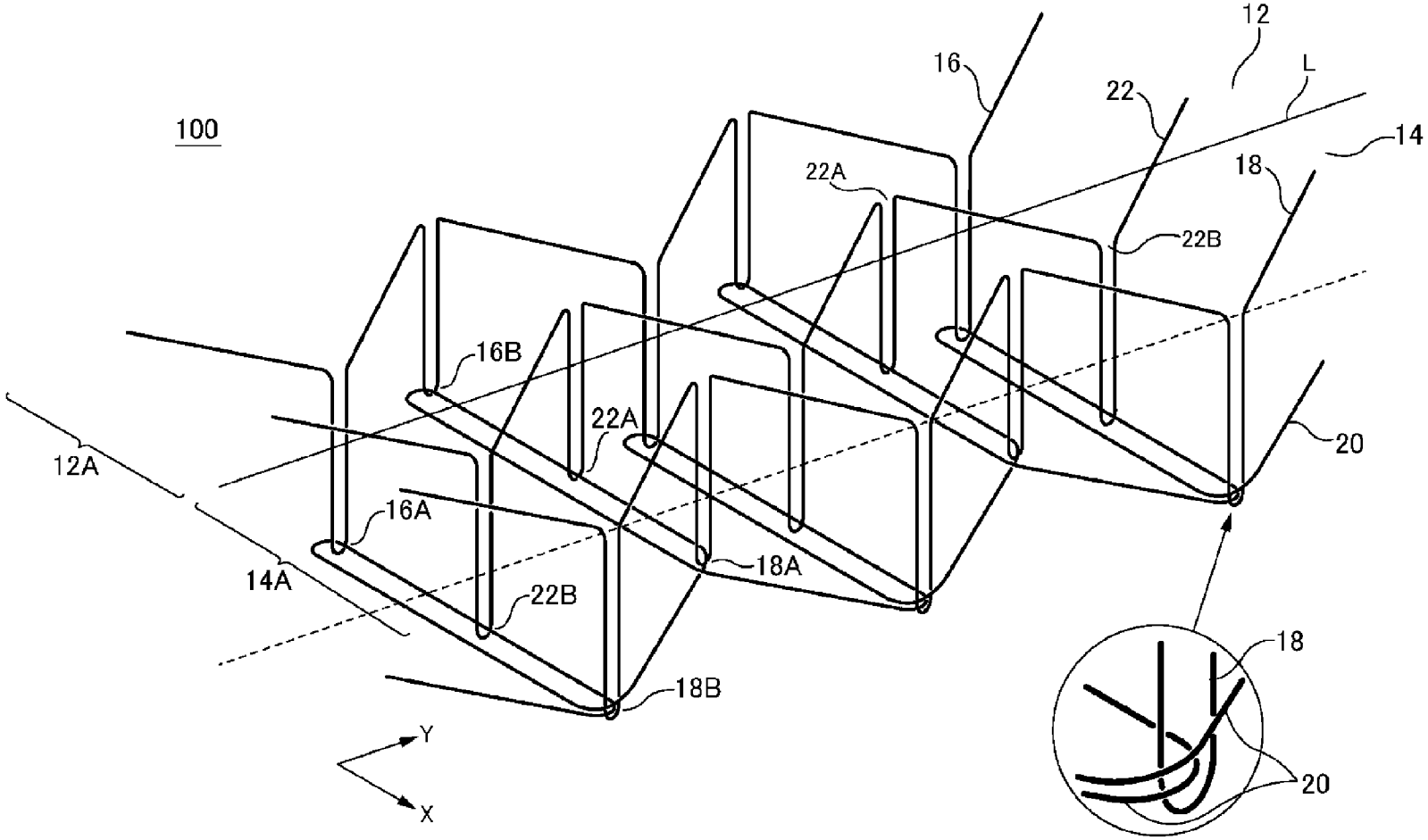
FIG. 10 is a three-dimensional view showing a sewing configuration of a stitched portion.

FIG. 10 is a three-dimensional view showing a sewing configuration of the stitched portion. As shown in this figure, following the configuration of the bobbin thread 20 in the Y direction, the bobbin thread 20 forms a knot together with the needle thread 18 at the turning point 18B, and forms a knot together with the needle thread 22 at the next turning point 22B. The bobbin thread 20 forms a knot together with the needle thread 16 at the turning point 16A, passes through the turning points 22B and 18B, and forms a knot together with the needle thread 18 at the turning point 18A. The bobbin thread 20 forms a knot together with the needle thread 22 at the turning point 22A, and forms a knot together with the needle thread 16 at the turning point 16B. The bobbin thread 20 passes through the turning points 22A and 18A and then forms a knot together with the needle thread 18 at the turning point 18B. These configurations are repeated.

Figure 11:
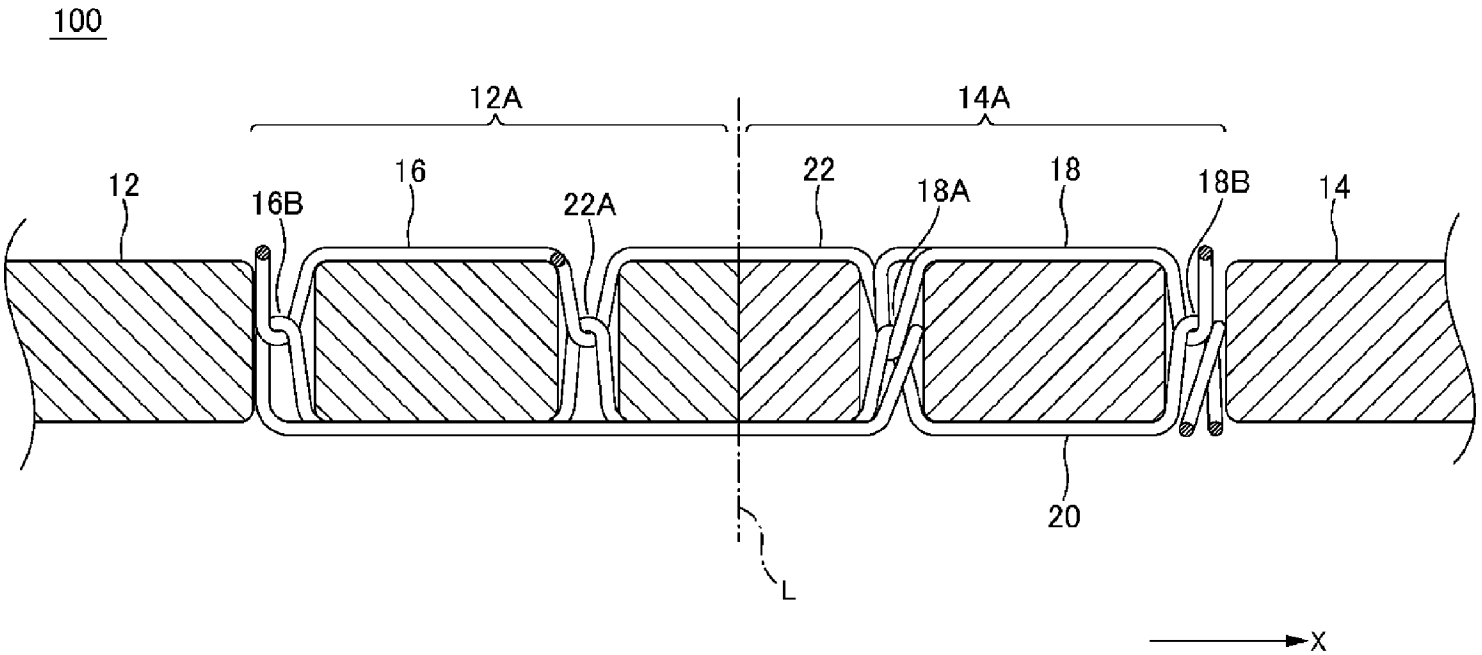
FIG. 11 is a cross-sectional view taken along line 11-11 in FIG. 8.

FIG. 11 is a cross-sectional view taken along line 11-11 in FIG. 8. As shown in this figure, the needle thread 22 and the bobbin thread 20 which are interlocked together surround the material edges while bridging over the boundary line L. At one side of the boundary line, the needle thread 16 and the bobbin thread 20 which are interlocked together surround the material edge 12A. At the other side of the boundary line, the needle thread 18 and the bobbin thread 20 which are interlocked together surround the material edge 14A.

Here, the tension of the needle thread 22 and the bobbin thread 20 acts so as to compress the portions of the material edges 12A and 14A that are surrounded by the needle thread 22 and the bobbin thread 20. This consequently increases the density of the surrounded portions of the material edges 12A and 14A. In addition, the tension of the needle thread 18 and the bobbin thread 20 acts so as to compress the portion of the material edge 14A that is surrounded by the needle thread 18 and the bobbin thread 20. This consequently increases the density of the surrounded portion of the material edge 14A.

Since the density of the stitched portion of the sewn product 100 according to this embodiment is increased by being compressed with three needle threads 16, 18 and 22 and one bobbin thread 20 at three positions, including the central portion in the width direction and both sides of the central portion, the tensile strength of the stitched portion can be increased than in the sewn product 10 according to the above-described embodiment. The sewn product 100 may be made using three sewing needles in the similar method as in the sewn product 10 as described above.

Although some embodiments of the present invention have been described, these embodiments are provided only for better understanding of the invention but not intended to limit the interpretation of the invention. The invention can be altered and improved without departing from the purpose thereof, and includes equivalents thereof. For instance, although the material edges 12A and 14A of the two pieces of material 12 and 14 are stitched together in the foregoing embodiments, material edges of one piece of material may be stitched together. In addition, although the turning points 16A and 18A are disposed on the boundary line L of the material edges 12A and 14A, the turning points 16A and 18A may be disposed on the material edge 12A or on the material edge 14A.

The invention claimed is:

1. A sewn product in which one material edge and the other material edge are stitched together in an abutted state, wherein the one material edge and the other material edge are stitched together with one bobbin thread and a plurality of needle threads, the plurality of needle threads being interlocked with the one bobbin thread to form a plurality of rows of zigzag stitched seams, and wherein the plurality of needle threads are interlocked with the one bobbin thread in a plurality of places and in each of the places only one of the plurality of needle threads is interlocked with the one bobbin thread.

2. The sewn product according to claim 1, wherein two rows of the plurality of rows of zigzag stitched seams are formed by two needle threads of the plurality of needle threads, and wherein the one material edge is overedge-stitched by one of the two needle threads and the bobbin thread, and the other material edge is overedge-stitched by the other of the two needle threads and the bobbin thread.

3. The sewn product according to claim 1, wherein three rows of the plurality of rows of zigzag stitched seams are formed by three needle threads of the plurality of needle threads, wherein one of the three needle threads is stitched alternately to the one material edge and the other material edge, and wherein the other two of the three needle threads are stitched to the one material edge or the other material edge at both sides of the one needle thread.

4. A sewing method of material in which one material edge and the other material edge are stitched together in an abutted state, the sewing method comprising interlocking a plurality of needle threads with one bobbin thread such that the plurality of needle threads form a plurality of rows of zigzag stitched seams to stitch the one material edge and the other material edge together, wherein the plurality of needle threads interlock with the one bobbin thread in a plurality of places and in each of the places only one of the plurality of needle threads is interlocked with the one bobbin thread.

5. The sewing method of material, according to claim 4, wherein the one material edge and the other material edge are stitched together with using a sewing machine which comprises a vertical full rotation shuttle and a plurality of sewing needles, the plurality of sewing needles being arranged in a direction perpendicular to a feed direction of the material and being swayable in the direction perpendicular to the feed direction of the material.

6. The sewing method of material, according to claim 4, wherein the one material edge is overedge-stitched by one of the plurality of needle threads and the bobbin thread, and the other material edge is overedge-stitched by a different one of the plurality of needle threads and the bobbin thread.

* * * * *